US005085792A

United States Patent [19]

Narihiko et al.

[11] Patent Number: 5,085,792

[45] Date of Patent: Feb. 4, 1992

[54] SYNTHETIC TRACTION FLUID

[75] Inventors: Yoshimura Narihiko; Hirotaka Tamizawa; Yasuji Komatsu, all of Saitama, Japan

[73] Assignee: Toa Nenryo Kogyo, K.K., Tokyo, Japan

[21] Appl. No.: 303,524

[22] Filed: Jan. 27, 1989

Related U.S. Application Data

[63] Continuation of Ser. No. 65,826, Jun. 23, 1987, abandoned.

[51] Int. Cl.[5] ..... C10M 105/36; C10M 129/72

[52] U.S. Cl. ..... 252/79; 252/56 R; 252/56 S; 252/57; 252/73

[58] Field of Search ..... 252/73, 76, 79, 56 R, 252/56 S, 57

[56] References Cited

U.S. PATENT DOCUMENTS 3,803,037 4/1974 Wygant ..... 252/32.7 E 4,886,614 12/1989 Yoshimura et al. ..... 252/79

FOREIGN PATENT DOCUMENTS 1593113 7/1981 United Kingdom .

*Primary Examiner*—Paul Lieberman

*Assistant Examiner*—Christine A. Skane

*Attorney, Agent, or Firm*—M. B. Kapustij; R. A. Maggio

[57] ABSTRACT

A traction fluid comprising:

(i) at least one diester or its derivative represented by the formula

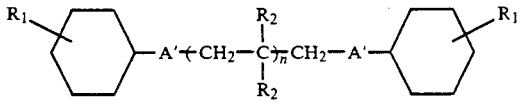

wherein A′ is an ester linkage, n is an integer of 1 to 6, $R_1$ is independently selected from hydrogen and alkyl groups containing from 1 to 8 carbon atoms, and $R_2$ is independently selected from alkyl groups containing from 1 to 3 carbon atoms; and (ii) from 0.1 to 70 wt. % of at least one branched poly-alpha-olefin.

12 Claims, No Drawings

SYNTHETIC TRACTION FLUID

This is a continuation of application Ser. No. 065,826, filed June 23, 1987 now abaondoned.

FIELD OF THE INVENTION

This invention relates to a traction fluid. More particularly, the present invention is concerned with a traction fluid comprising a mixture or blend of a diester having two cyclohexyl rings and a branched poly-alpha-olefin as the base oil.

BACKGROUND OF THE INVENTION

Traction drive power transmissions, which transmit power to a driven part through a traction drive mechanism, have recently attracted attention in the field of automobiles and industrial machinery. The traction drive mechanism is a power transmitting mechanism using a rolling friction. Unlike conventional drive mechanisms it does not use any gears, which enables reduction of vibration and noise as well as a smooth speed change in high-speed rotation. An important goal in the automobile industry is improvement in the fuel consumption of automobiles. It has been suggested that if the traction drive is applied to the transmission of automobiles to convert the transmission to the continuous variable-speed transmission fuel consumption can be reduced by at least 20% compared to conventional transmission systems since the drive can always be in the optimum speed ratio. Recent studies have resulted in the development of materials having high fatigue resistance as well as in theoretical analysis of traction mechanisms. As regards the traction fluid, the correlation of traction coefficients is gradually being understood on a level of the molecular structure of the components. The term "traction coefficient" as used herein is defined as the ratio of the tractional force which is caused by slipping at the contact points between rotators which are in contact with each other in a power transmission of the rolling friction type to the normal load The traction fluid is required to be comprised of a lubricating oil having a high traction coefficient. It has been confirmed in this connection that a traction fluid possessing a molecular structure having a naphthene ring exhibits a high performance: "Santotrack ®" manufactured by the Monsanto Chemical Company is widely known as a commercially available traction fluid. Japanese Patent Publication No. 35763/1972 discloses di(cyclohexyl)alkane and dicyclohexane as traction fluids having a naphthene ring. This patent publication discloses that a fluid obtained by incorporating the above-mentioned alkane compound in perhydrogenated (alpha-methyl)styrene polymer, hydrindane compound or the like has a high traction coefficient. Further, Japanese Patent Laid-Open No. 191797/1984 discloses a traction fluid containing an ester compound having a naphthene ring. It discloses that an ester obtained by the hydrogenation of the aromatic nucleus of dicyclohexyl cyclohexanedicarboxylate or dicyclohexyl phthalate is preferred.

As mentioned above, in recent years the development of continuous variable-speed transmissions has advanced. The higher the traction coefficient of the lubricating fluid the larger the transmission force in the same device. This allows a reduction in size of the entire device as well as a reduction in polluting exhaust gases.

Therefore, there is a strong demand for a fluid having a traction coefficient as high as possible. However, even the use of Santotrack ®, which is a traction fluid having the highest performance of all the currently commercially available fluids, in such a traction drive device provides unsatisfactory performance with respect to the traction coefficient, and is expensive. The traction fluid which has been proposed in Japanese Patent Publication No. 35763/1971 Contains Santotrack ® or its analogue as a component and, therefore, is also unsatisfactory with respect to performance and cost.

The present inventors have made extensive and intensive studies with a view to developing a traction fluid which not only exhibits a high traction coefficient but is also inexpensive. As a result, the inventors have found that the addition of a specific amount of a branched poly-alpha-olefin to a diester or its derivative having two cyclohexyl rings can economically provide a high-performance base oil fluid. The present invention has been made based on this finding.

SUMMARY OF THE INVENTION

A traction fluid exhibiting a high traction coefficient comprising (i) from 0.1 to 70 wt. % of a branched poly-alpha-olefin, and (ii) a diester or its derivative containing two cyclohexyl or alkyl substituted cyclohexyl moieties connected by ester bonds to an acyclic hydrocarbyl radical.

DETAILED DESCRIPTION OF THE INVENTION

According to the present invention there is provided a traction fluid comprising a mixture or blend of (i) a diester or its derivative represented by the following general formula:

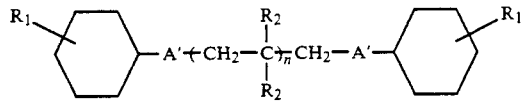

and (ii) from 0.1 to 70 % by weight of a branched poly-alpha-olefin. In the above formula A, is an ester linkage of —COO— or —OOC—, n is an integer of 1 to 6, $R_1$ is independently selected from hydrogen and alkyl groups having 1 to 8 carbon atoms, and $R_2$ is independently selected from alkyl groups having 1 to 3 carbon atoms.

A first object of the present invention is to provide a high-performance traction fluid having a high traction coefficient. A second object of the present invention is to provide a traction fluid which is not only economical but also readily available and easily applicable to transmissions.

The traction fluid of the present invention comprises a base oil comprised of two components, i.e., component A comprised of a diester or its derivative and a specific amount of component B comprised of a branched poly-alpha-olefin In the present invention the component A is a diester or its derivative having two cyclohexyl rings which is represented by the above-mentioned structural formula. A' of the ester linkage is —COO— or —OOC—, and the number, n, of the repeating units of gemdialkyl structure is 1 to 6, preferably 1 to 3. When n is zero the traction coefficient is low, while when n is 7 or more the viscosity is unfavorably high. This diester or derivative thereof has a viscosity of 20 to 50 cst, preferably 24 to 30 cst at 40° C., and 4 to 10 cst, preferably 4 to 6 cst at 100° C. Further, the viscosity index is preferably in the range of 40 to 100, particularly preferably in the range of 50 to 80.

The component A can be prepared by the following method. Specifically, the component A can be obtained by the esterification reaction of a glycol compound with a cyclohexanecarboxylic acid compound. The glycol compound to be used has 1 to 6 gem-dialkyl structural units. A preferred glycol compound is neopentyl glycol. Examples of the cyclohexanecarboxylic acid compound include, besides cyclohexanecarboxylic acid, those having an alkyl group with 1 to 8 carbon atoms, e.g., methylcyclohexanecarboxylic acid, ethylcyclohexanecarboxylic acid, etc. Cyclohexanecarboxylic acid is particularly preffered. The esterification reaction is conducted using substantially stoichiometric amounts of the reactants or in the presence of an excess amount of the acid. The former method requires the use of a catalyst and further has the problem that a monoalcohol is produced as the by-product. Therefore, it is preferred that the esterification reaction be conducted in the presence of an excess amount of the acid. Specifically, 1 mol of the glycol compound is reacted with the acid in 2 to 5-fold by mol excess (particularly preferably in 2.5 to 4-fold by mol excess). The reaction temperature is about 150° to 250° C., preferably 170° to 230° C., and the reaction time is 10 to 40 hr, preferably 15 to 25 hrs. Although the esterification reaction may be conducted under either elevated or reduced pressures, it is preferred that the reaction be conducted at atmospheric pressure from the standpoint of ease of reaction operation. Under this condition, the excess acid serves as a catalyst. An alkylbenzene such as xylene or toluene can be added in a suitable amount as a solvent. The addition of the solvent enables the reaction temperature to be easily controlled. As the reaction proceeds water formed during the reaction evaporates. The reaction is terminated when the amount of water reaches twice by mol that of the alcohol. The excess acid is neutralized with an aqueous alkaline solution and removed by washing with water. When an acid which is difficult to extract with an alkali washing is used the reaction is conducted using the acid in an amount of 2 to 2.5-fold mol excess over the alcohol in the presence of a catalyst. Examples of the catalyst include phosphoric acid, p-toluenesulfonic acid and sulfuric acid. The most preferred catalyst is phosphoric acid because it enhances the reaction rate and increases the yield of the ester. The reaction product is finally distilled under reduced pressure to remove water and the solvent, thereby obtaining the diester compound of the present invention.

The component A of the present invention can also be prepared by the esterification reaction of a cyclohexanol compound with a dicarboxylic acid having a quaternary carbon atom. In this case, cyclohexanol, methylcyclohexanol or the like is used as the cyclohexanol compound, while neopentyldicarboxylic acid or the like is used as the dicarboxylic acid.

The poly-alpha-olefin component B has a quaternary carbon atom or a tertiary carbon atom in its main chain and is a polymer of an alpha-olefin having 3 to 5 carbon atoms or the hydrogenation product thereof. Examples of the poly-alpha-olefins include polypropylene, polybutene, polyisobutylene, polypentene and the hydrogenation products thereof. Particularly preferred are polybutene and polyisobutylene and the hydrogenation products thereof. The polyisobutylene is represented by the following structural formula:

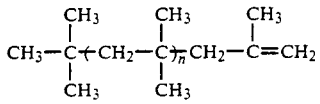

pp The hydrogenation product of the polyisobutylene is represented by the following structural formula:

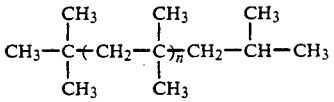

In the above-mentioned formula the degree of polymerization, n, is 6 to 200.

Although the polybutene and polyisobutylene are generally commercially available, they may be produced by conventional polymerization methods. The hydrogenation product thereof is produced by reacting polyisobutylene or the like in the presence of hydrogen. The molecular weight of the poly-alpha-olefin is preferably in the range of 500 to 10,000, more preferably in the range of 900 to 5,000. The molecular weight can be adjusted by suitable methods such as decomposition of a poly-alpha-olefin having a high molecular weight and mixing of poly-alpha-olefins having different molecular weights. Although an alpha-olefin copolymer (OCP) is a type of a poly-alpha-olefin, it is unsuited for use as component B in the present invention. This is because OCP is obtained by polymerization of two or more alpha-olefins and such a structure wherein these alpha-olefins are irregularly linked, as opposed to the polybutene, etc. of the present invention which have a regular gemdialkyl structure.

Component A of the present invention, e.g., neopentyl glycol cyclohexanecarboxylic acid diester, exhibits a traction coefficient of 0.100 to 0.104 , while component B, e.g., polybutene, exhibits a traction coefficient of 0.075 to 0.085.

Since component A of the present invention exhibits a high traction coefficient, its use alone in a traction drive device results in a high performance. However, a further improved traction fluid can be obtained by blending component A with 0.1 to 70% by weight, particularly 10 to 70% by weight, of component B. Specifically, although component B has a lower traction coefficient than component A, the gem-dimethyl-group in component B cooperates with the cyclohexyl ring in component A to exhibit a synergistic effect (with respect to improvement of traction coefficient). Further, since component B is inexpensive and exhibits excellent viscosity characteristics, a traction fluid can be economically obtained by blending component A with 0.1 to 70% by weight of component B without lowering the traction coefficient.

Various additives may also be added to the traction fluid of the present invention depending upon the applications thereof. Specifically, when the traction device undergoes high temperatures and large loads, at least one additive selected from among an antioxidant, a wear inhibitor and a corrosion inhibitor may be added in an amount of 0.01 to 5% by weight. Similarly, when a high viscosity index is required a known viscosity index improver is added in an amount of 1 to 10% by weight. However, since the use of polymethacrylate and olefin copolymer unfavorably lowers the traction coefficient, it is preferred that, if they are present, they be used in an amount of 4% by weight or less.

The term "traction fluid" as used in the present invention is intended to mean a fluid for use in devices which transmit a rotational torque through point contact or line contact, or for use in transmissions having a similar structure. The traction fluid of the present invention exhibits a traction coefficient higher than those of conventionally known fluids, i.e., exhibits a traction coefficient 1 to 5% higher than those of the conventional fluids, although the value varies depending on the viscosity. Therefore, the traction fluid of the present invention can be advantageously used for relatively low power drive transmissions including internal combustion engines of small passenger cars, spinning machines and food producing machines, as well as large power drive transmissions such as industrial machines, etc.

The traction fluid of the present invention exhibits a remarkably superior traction coefficient relative to the conventional fluids. The reason why the traction fluid of the present invention exhibits a high traction coefficient is not yet fully understood. However, basically, the reason is believed to reside in the unique molecular structure of the traction fluid of the present invention.

The traction fluid of the present invention comprises a diester. The diester has two cyclohexyl rings in its molecule which are bonded to each other through two ester linkages. The two ester linkages bring about an interdipolar force between the molecules It is believed that the interdipolar force serves to bring the fluid into a stable glassy state under high load conditions, thereby increasing the shearing force. Further, the traction fluid of the present invention has a quaternary carbon atom of the gem-dialkyl type which is bonded to the two cyclohexyl rings through a methoxycarbonyl linkage. This suppresses the internal rotation. Therefore, when the traction device is under high load conditions the cyclohexyl rings are firmly engaged, like gears, with the gem-dialkyl portion of the quaternary carbon atom, while when the device is released from the load, the engagement is quickly detached, thereby causing fluidization.

The following Examples are provided for illustrative purposes only and are not to be construed as limiting the invention described herein.

EXAMPLES 1-9

Diester of neopentyl glycol cyclohexane carboxylic acid compound of the present invention was synthesized using the following materials.

First, 1 mol of neopentyl glycol is mixed with 3 mols of cyclohexane carboxylic acid and reacted for 20 hours at a reaction temperature of 200° C. under atmospheric pressure. Since the acid is in excess in the mixture during the reaction, no catalyst is used and xylene is added as a solvent. The reaction is terminated when the water which has vaporized as the reaction proceeds has reached 2 mols of alcohol. The reaction product is washed with an alkaline solution (caustic soda) to remove the excess acid, and is further washed with water until it becomes neutral, followed by vacuum distillation so as to remove water and xylene, thereby isolating the diester of the present invention.

The diester thus produced was blended with different amounts of polybutene having an average molecular weight of 420 to 2350, as set forth in Table I, followed by measurement of traction coefficient The conditions of measurement of the traction coefficient were as follows:

measuring equipment: Soda-type four-roller traction testing machine test conditions: a fluid temperature of 20° C.; a roller temperature of 30° C.; a mean Hertzian pressure of 1.2 GPa; a rolling velocity of 3.6 m/s; and a slipping ratio of 3.0%.

The traction fluid of the present invention was found to be remarkably superior in traction performance to conventional traction fluids as shown in Table 1.

COMPARATIVE EXAMPLES 1-7

The traction coefficients were measured under the same conditions as those used in the above examples with respect to a traction fluid consisting of 100% by weight of component B, a traction fluid obtained by blending 10% by weight of component A with 90% by weight of B component, a traction fluid obtained by blending component A with OCP or PMA, and a commercially available traction fluid "Santotrack ®". The results are shown in Table 1. As can be seen from the data in Table 1, all the comparative samples exhibited traction coefficients 1 to 5% smaller than these of the diester compound of the present invention. It is noted in this connection that an olefin copolymer, i.e., copolymer (having an average molecular weight of 150,000 to 300,000) of ethylene with propylene was used as OCP, while polymethacrylate having an average molecular weight of 50,000 to 300,000 was used as PMA.

The traction fluid of the present invention comprises at least one component A having two cyclohexyl rings and linear-chain hydrocarbons as the skeleton and a specific amount of a component B comprised of a branched poly-alpha-olefin. Such a traction fluid not only exhibits an extremely high traction coefficient but is also inexpensive and exhibits excellent viscosity characteristics.

Therefore, the use of the traction fluid of the present invention in a power transmission, particularly a traction drive device, results in a remarkable increase in shearing force under a high load. This enables a reduction in size of the device which leads to lower costs of the device.

TABLE I

| | A | B | | | | | |
|---|---|---|---|---|---|---|---|
| | Compound amount | Molecular weight | Compound amount | Viscosity (cst) 40° C. | Viscosity (cst) 100° C. | Viscosity index | Traction coefficient |
| Reference Example | 100 | — | 0 | 25.73 | 4.33 | 53 | 0.101 |
| 1 | 90 | 420 | 10 | 26.96 | 4.47 | 64 | 0.100 |
| 2 | 90 | 900 | 10 | 43.26 | 5.86 | 66 | 0.103 |
| 3 | 80 | " | 20 | 72.25 | 8.25 | 77 | 0.104 |
| 4 | 70 | " | 30 | 123.7 | 11.72 | 79 | 0.102 |
| 5 | 60 | " | 40 | 204.3 | 19.79 | 111 | 0.100 |
| 6 | 90 | 1260 | 10 | 45.76 | 6.71 | 99 | 0.102 |

TABLE I-continued

| | A | B | | | | | |
|---|---|---|---|---|---|---|---|
| | Compound amount | Molecular weight | Compound amount | Viscosity (cst) 40° C. | Viscosity (cst) 100° C. | Viscosity index | Traction coefficient |
| 7 | 70 | " | 30 | 166.1 | 17.24 | 112 | 0.104 |
| 8 | 90 | 2350 | 10 | 60.31 | 8.64 | 116 | 0.104 |
| 9 | 70 | " | 30 | 407.8 | 34.39 | 124 | 0.104 |
| Compr'n | | | | | | | |
| 1 | 0 | 900 | 100 | 11600 | 240 | 108 | 0.081 |
| 2 | 10 | " | 90 | 2882 | 154 | 155 | 0.089 |
| 3 | 96 | OCP | 5 | 36.80 | 9.70 | 264 | 0.097 |
| 4 | 90 | " | 10 | 108.9 | 26.41 | 277 | 0.097 |
| 5 | 90 | PMA | 10 | 35.51 | 9.25 | 259 | 0.097 |
| 6 | 70 | " | 30 | 151.5 | 34.73 | 273 | 0.095 |
| 7 | | "Santotrack ®" | | 13.84 | 2.99 | 46 | 0.087 |

What is claimed is:

1. A traction fluid comprising:

(i) at least one diester or its derivative represented by the formula

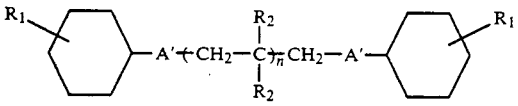

wherein A' is the ester linkage —COO—, or —OOC—, n is an integer of 1 to 6, $R_1$ is independently selected from hydrogen and alkyl groups containing from 1 to 8 carbon atoms, and $R_2$ is independently selected from alkyl groups containing from 1 to 3 carbon atoms; and (ii) from 0.1 to 70 wt. % of at least one branched poly-alpha-olefin selected from the group consisting of branched poly-alpha-olefins having an average molecular weight of from 500 to 10,000.

2. The traction fluid of claim 1 wherein said poly-alpha-olefin is polyisobutene.

3. The traction fluid of claim 2 wherein said alkyl group represented by $R_1$ contains from 1 to 4 carbon atoms.

4. The traction fluid of claim 2 wherein said polyisobutene has an average molecular weight of from 900 to 5,000.

5. The traction fluid of claim 2 wherein $R_2$ is a methyl group.

6. The traction fluid of claim 2 which contains from 10 to 70% by weight of said polyisobutene.

7. The traction fluid of claim 1 which contains from 10 to 70% by wight of said poly-alpha-olefin.

8. The traction fluid of claim 1 wherein said alkyl groups represented by $R_1$ contain from 1 to 4 carbon atoms.

9. The traction fluid of claim 1 wherein said poly-alpha-olefin has an average molecular weight of 900 to 5,000.

10. The traction fluid of claim 1 wherein n is an integer of from 1 to 3.

11. The traction fluid of claim 1 wherein $R_2$ is a methyl group.

12. The traction fluid of claim 1 wherein both of $R_2$ are the same.

* * * * *